United States Patent [19]

Nowak et al.

[11] Patent Number: 4,919,448

[45] Date of Patent: Apr. 24, 1990

[54] HEEL PIECE FOR A SAFETY SKI BINDING INCLUDING SINK AND DETENT MECHANISMS

[75] Inventors: Gerhard Nowak, Biedermannsdorf; Alfred Winter; Hans P. Morbitzer, both of Vienna; Rudolf Theuer, Trumau; Klaus Kruschik, Gumpoldskirchen, all of Austria

[73] Assignee: TMC Corporation, Barr/Zug, Switzerland

[21] Appl. No.: 134,823

[22] Filed: Dec. 18, 1987

[30] Foreign Application Priority Data

Dec. 22, 1986 [AT] Austria ..... 3405/86

[51] Int. Cl.[5] ..... A63C 9/081

[52] U.S. Cl. ..... 280/618; 280/626; 280/634

[58] Field of Search ..... 280/617, 618, 623, 626, 280/628, 631, 634

[56] References Cited

U.S. PATENT DOCUMENTS 4,616,843 10/1986 Freisinger et al. ..... 280/618
4,624,473 11/1986 Knabel et al. ..... 280/626
4,693,489 9/1987 Stepanek et al. ..... 280/634

FOREIGN PATENT DOCUMENTS 1703638 2/1972 Fed. Rep. of Germany .
3107230 2/1981 Fed. Rep. of Germany .
3311901A 10/1984 Fed. Rep. of Germany .
WO84/03050 8/1984 PCT Int'l Appl. .

*Primary Examiner*—Charles A. Marmor
*Assistant Examiner*—Richard Camby
*Attorney, Agent, or Firm*—Finnegan, Henderson, Farabow, Garrett & Dunner

[57] ABSTRACT

The invention relates to a heel-piece for a safety ski binding, the heel-piece being released when the load on the binding exceeds a specified limit. A link mechanism is mounted on the heel-piece for connecting the sole-holder to the binding plate of the ski. The link mechanism is engaged by two spindles, which in the operational position of the heel-piece are transverse to the ski and parallel to its surface. The sole-holder is connected by the link mechanism to the binding plate and to the spindles, these components being mutually engaged by a spring-loaded detent/detent-track. In order to achieve compensation for defective settings of the heel-holder, the invention provides that the sole-holder is connected to the binding plate only by the link mechanism. Further, one of the components of the detent/detent-track system is connected with one of the binding plate and the sole-holder and the other component of the detent/detent-track is connected with the other of the binding plate and the sole holder.

23 Claims, 8 Drawing Sheets

HEEL PIECE FOR A SAFETY SKI BINDING INCLUDING SINK AND DETENT MECHANISMS

BACKGROUND OF THE INVENTION

1. Field of the Invention

The invention relates to a heel-piece for a safety ski binding, the heel-piece being released when a specific load exerted on the binding is exceeded. A link mechanism is provided between the sole-holder and the binding plate of the ski, the link mechanism including two pivot pins, which in the operational position of the heel-piece, are transverse to the ski and parallel to its surface. The sole-holder is connected by the link mechanism, including the pivot pins, to the binding plate. The sole-holder and the binding plate are mutually engaged by a spring-loaded detent and detent-track.

2. Description of the Related Art

German Offenlegungsschrift No. 31 07 230 discloses a heel-piece comprising a carriage displaceable essentially transversely to the longitudinal axis of the ski and held in its center position by a spring-loaded detent-track and a detent snapping into the detent-track. This carriage is operationally displaceable relative to the ski upon suitable torques exerted on the heel-piece and supports a pivoting link mechanism within which is held a release mechanism. The link mechanism is locked by an elbow lever hingedly connected at its ends to the carriage and to the link mechanism. A pivoting lever is pivotably fastened on the carriage and is received in a groove of a base plate fixed to the ski. The pivot lever blocks the elbow of the elbow lever at the center of the excursion of the carriage and releases the elbow the moment the carriage has been displaced from the center, whereby the link mechanism and hence the release mechanism can be swung upwardly.

This arrangement has the disadvantage of being cumbersome and costly in design. Moreover, it fails to provide compensation for minor changes in the length of the sole of the boot held by the heel-piece, or compensation for a layer of snow on the sole, even if relatively slight.

Also, WO No. 84/03050 discloses a heel-piece of the type discussed above. In this heel-piece the sole-holder is connected by an elbow lever to the binding plate of a ski and rests at its center pivot point on a spring-loaded lever with a detent-track. Further, the sole holder is connected by a double lever to the binding plate. A link mechanism is held on the binding plate and intersects the double lever, which further pivots at one of its ends on the sole holder. Because the two hinge points of the sole-holder are comparatively close to each other, and because the part of the elbow lever and of the double lever pivoting on the hinge points are of different lengths, the longitudinal displacement of the ski binding entails a very complex motion of the sole holder, during which the spacing between the fastening strip of the sole-holder and the surface of the ski changes. As a result, the compression of the boot on the ski varies considerably and thereby increases the frictional forces to be overcome to release the ski binding in the event of a twisting fall. Therefore, the snow layers adhering to the vertical surfaces in the toe and the heel areas of the boot will also affect the release.

It is an object of the present invention to avoid these drawbacks and to provide a heel-piece which is characterized by a simple design which allows for length compensation, thereby compensating for snow layers on the sole in the absence of significant variations in the release values. This object is achieved in the present invention by connecting the sole-holder to the binding plate by only the link mechanism and by connecting one of the components of the detent/detent-track to one of the binding plate and the sole-holder and by connecting the other component to the other of the binding plate and the sole holder. The detent-track slants in a known manner relative to the ski topside, and the detent and the detent-track engage each other. Because only one pivoting connection is present between the sole-holder and the binding plate, namely the pivot pins of the link mechanism, a longitudinal displacement of the sole-holder relative to the binding plate produces practically no change in boot pressure on the ski. Despite the resulting compression of the compression spring of the detent mechanism of the detent mechanism, the set released values therefore remain substantially constant.

For the sake of simplicity of design, the link mechanism is mounted on the end of the sole-holder opposite the toe piece and is substantially vertical in the operational position of the heel-piece. Even if the link mechanism is comparatively short, it may nevertheless compensate length changes in the sole, and this is significant in particular for soles made of hygroscopic materials.

It is preferable that the detent-track of the present invention is pivotably mounted on a pivot arm fastened to the binding plate. It is further preferable that the detent comprises a roller rotatably supported on a sole-holder, the arm resting on a compression spring, which, in turn rests on a support controlled by a release mechanism. By means of this arrangement, the opening of the heel-piece caused by the sole-holder pivoting upwardly following release is covered by the pivot arm with the detent-track, whereby, in the event of a fall, no snow may enter the inside of the heel-piece. As a result, heel-piece malfunctions are often averted.

According to another feature of the present invention, the abutment controlled by the release mechamism comprises a support arm pivotably fastened to the binding plate and a snap-in arm which supports the support arm in the operational position. The support arm is pivotally connected to the pivot arm by a coupling rod guiding the compression spring and loads, in a known manner, the snap-in arm in its longitudinal direction. The compression spring is preferably substantially parallel to the ski surface. This arrangement provides the advantage that the snap-in arm can be displaced by relatively small forces from the position where it supports the support arm, whereby the snap-in arm, along with the compression spring, loses its support. Thereby, the sole-holder is unlocked from the binding plate. The support of the compression spring by the coupling rod is essential in this regard to avert stretching of the spring, which unevenly stretches it and causes premature fatigue.

Basically, the heel-piece of the invention is applicable both to a detachable toe piece and a non-detachable toe piece, which is frequently used in cross-country bindings. However, for reasons for high-release reliability, it will be appropriate when using the heel-piece of the invention together with a non-detachable toe piece that the heel-piece be used together with a binding plate. Thus, according to a further feature of the present invention, the heel-piece includes a binding plate fixed to the ski and pivotable about a vertical pivot boss located at the intersection of the tibia axis of the skier and the plane of the ski, and further about a pivot pin located in the front of the binding plate, transverse to the ski's longitudinal axis. The pivot boss is secured against rotation by a vertical pin or detector spaced from the pivot boss and received in a support fixed in the ski.

According to a further aspect of the invention, the detector preferably is connected by a transducer to the binding plate. This feature is especially suitable for heel-pieces with an electronically controlled release mechanism so that the forces acting on the binding can be sensed over very short distances. With this arrangement, any slight displacement of the plate relative to the ski is determined by the elasticity of the individual components of the plate, as well as the fastening of the binding plate on the ski, is sufficient to detect the applied forces. It is preferable that the transducer is mounted in a tightly sealed housing in which are located in electronic circuit analyzing the transducer output signals and a setting member controlling the snap-in arm. With this arrangement, short transmission paths are achieved for the transducer output signals and the highly sensitive electronic components are protected.

Additional objects and the advantages of the invention will be set forth in the description which follows, and in part will be obvious from the description, or may be learned by practice of the invention. The objects and advantages of the invention may be realized and obtained by means of the instrumentalities and combinations particularly pointed out in the dependent claims.

SUMMARY OF THE INVENTION

To achieve the foregoing objects, and in accordance with the purposes of the invention as embodied and broadly described herein, there is provided a heel-piece for a safety ski binding comprising a binding plate adapted to be fixedly attached to a ski; a sole-holder pivotally connected to the binding plate, the sole holder being pivotally movable on the binding plate from a closed position, in which the sole-holder is in operation, to an open position, in which the sole-holder is pivotally released from the ski; link means for connecting the sole-holder to the binding plate, the link means including a link arm and first and second pivot pins passing through the link arm to allow rotation of the link arm about the first and second pivot pins, the first and second pivot pins being substantially parallel to each other and substantially perpendicular to the longitudinal axis of the ski; and detent means for holding the sole-holder in the closed position, the detent means including a detent mounted on one of the binding plate and the sole-holder and the detent track mounted on the other of the binding plate and the sole-holder, the detent being positioned in the detent track.

BRIEF DESCRIPTION OF THE DRAWINGS

The accompanying drawings, which are incorporated and constitute a part of the specification, illustrate a presently preferred embodiment of the invention, and together with the general description given above and the detailed description of the preferred embodiment given below, serve to explain the principles of the invention.

Figure 3:
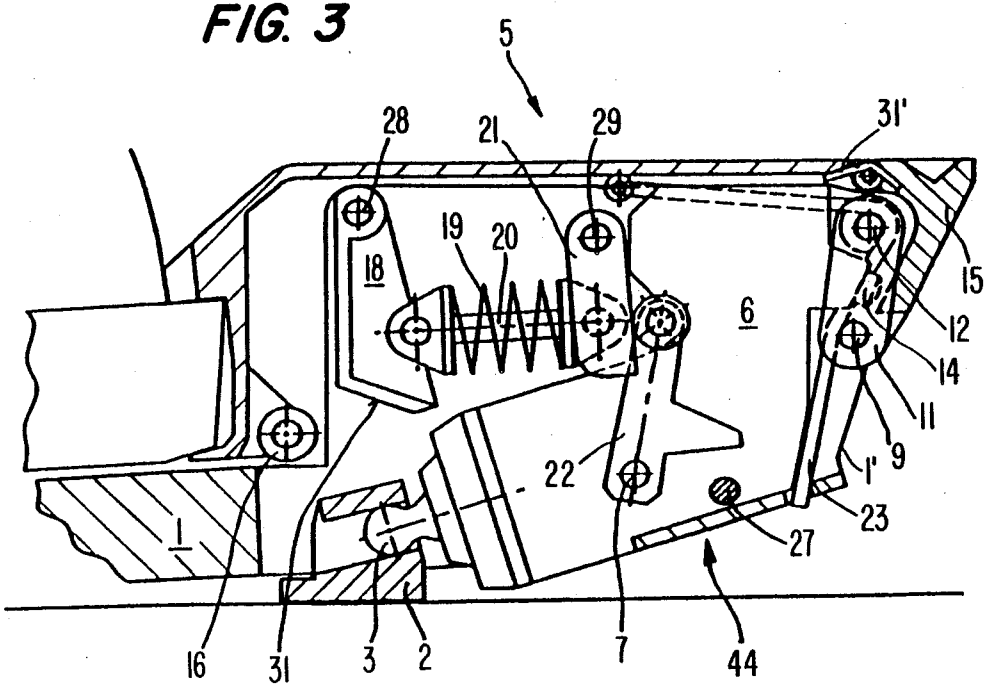
Figure 5:
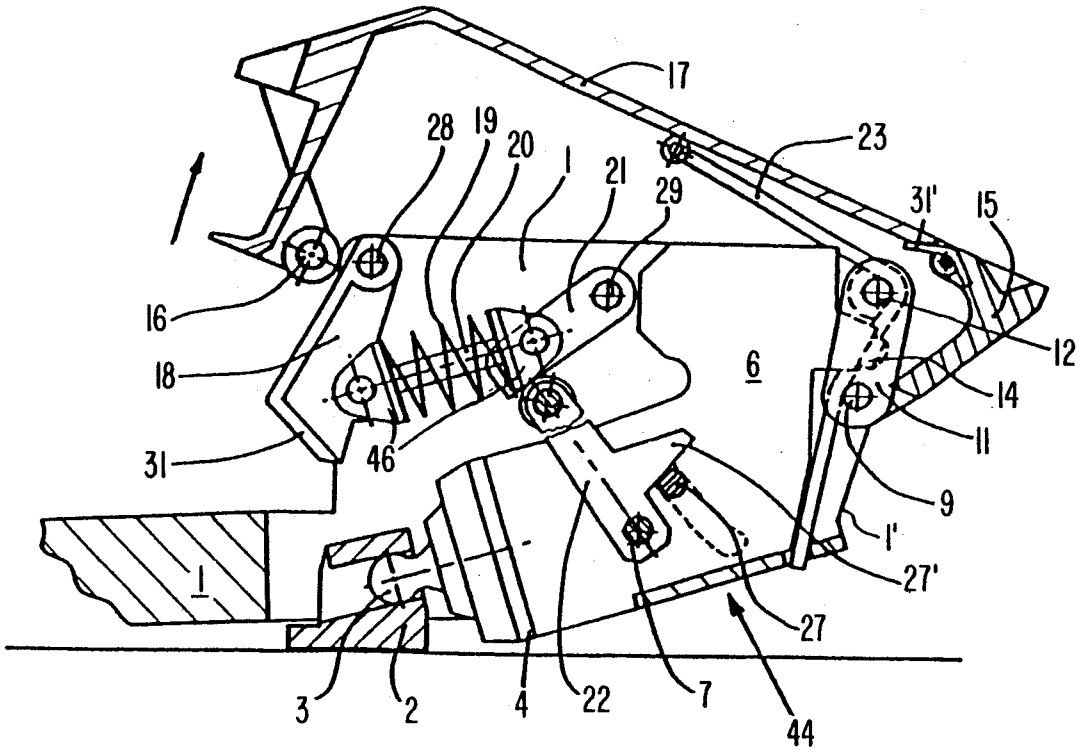

FIG. *2a* is a schematic of the heel-piece of the present invention when in the operational mode and in the optimum setting;

FIG. *2b* shows the heel-piece of FIG. *2a* in a slightly misadjustified position relative to the toe piece;

FIG. *2c* is the heel-piece of FIG. *2a* or FIG. *2b* a defective setting due to a layer of snow on the sole;

FIG. 3 is a heel-piece of FIGS. *2a–2c* in the released condition;

FIGS. *4a* and *4b* show the released heel-piece of FIG. 3 during lifting and twisting of the heel area of the ski boot; and FIG. 5 schematically shows the heel-piece of the present invention following release of the ski boot.

DESCRIPTION OF THE PREFERRED EMBODIMENT

Figure 1:
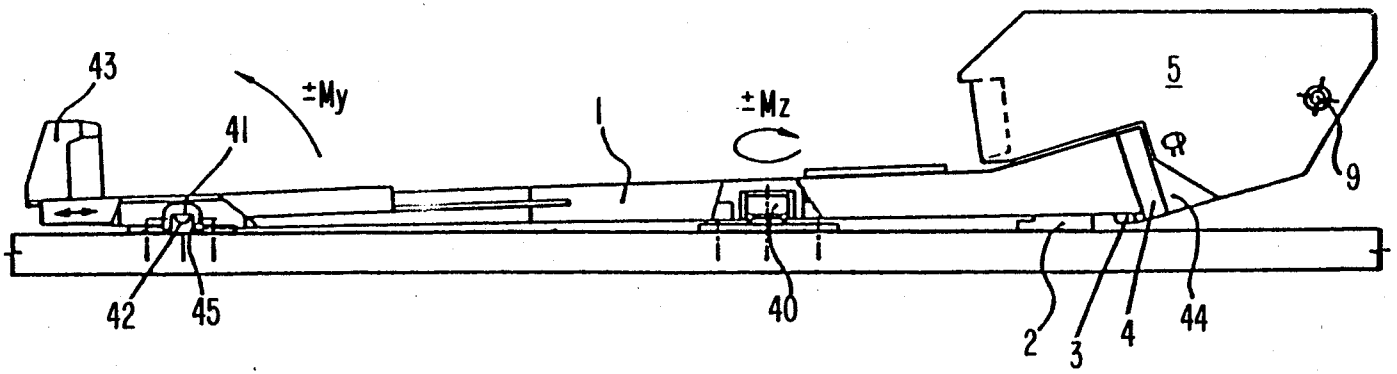
FIG. 1 is a schematic of the safety ski binding of the present invention.

Reference will now be made in detail to the present preferred embodiment of the invention as ilustrated in the accompanying drawings. In accordance with the present invention there is provided a safety ski binding as shown in FIG. 1. The binding is a plate binding, comprising a binding plate 1. The binding plate 1 is rotatable about a boss-like pivot 40 mounted at the intersection of the skier's tibia axis and the plane of the ski and allowing rotation of the binding plate 1 in the plane of the ski. The front region of the binding plate 1 comprises a spindle 41 engaging slot 42 and extending in the longitudinal direction of the ski. The spindle 41 is located in a fastener 45 fixed to the ski and entering with substantial play on all sides a recess 3' at the under side of the binding plate 1, thereby allowing restricted rotation of the binding plate 1 about the boss 40 and pivoting the binding plate 1 upwardly about the spindle 41.

A rigid, non-detachable toe piece 43 is held on the binding plate 1 and is adjustable and clampable in front of the binding plate 1. A detachable heel-piece is mounted on the rear of the binding plate 1 and is connected to the binding plate 1. The heel-piece 5 includes a sole-holder 17 upwardly pivotable about a pivot pin 9. The binding plate 1 is also rigidly attached at the rear thereof to a switch component 44 located next to a force pickup 4 and a detector 3 having a spherical end in a support 2 fixed to the ski. Thereby, the binding plate 1 is essentially fixed in its position. However, it may move within the operational excursion of the force pickup 4, thereby allowing the force pickup 4 to detect the torques $\pm$ Mz and $\pm$ My acting on the binding plate 1 because of the fixed centers of rotation of the binding plate 1 about the boss 40 and a spindle 41.

A conventional opening sping 23 is provided in the heel-piece for the sole-holder 17. The spring 23 rests on the binding plate 1 and the sole-holder 17 and pretresses the latter towards its upwardly pivoted position shown in FIG. 5.

The essentially hood-shaped sole-holder 17 is provided with an outwardly extending projection rotatably supporting a detent-roller 16. The detent-roller 16 is positioned under an arm 18 when the binding is locked. The arm 18 is pivotably supported on a pivot spindle 28, which in turn is fastened the binding plate 1. The arm 18 hinges on a coupling rod 20, which connects the arm 18 to a support lever 21. The support lever 21 pivots about a pivot spindle 29 which is attached to the binding plate 1. The coupling rod 20 is kept in a longitudinally displaceable manner and with substantial play in support means abutting both ends of a compression spring 19. The compression spring 19 forces apart the arm 18 and the support lever 21, which are connected by the coupling rod 20. The arm 18 is thereby forced against the detent-roller 16 when the support lever is supported, and hence the sole-holder 17 is prevented from swinging up.

A manual releas-head 15 is pivotably supported on a spindle 13 in the heel-piece 5 and is pre-stressed by a spring 31 towards its inoperative position. When the release-head 15 is actuated, it pivots counter-clockwise i.e., against the force of the spring 31. The release-head 15 also presses against a release pin 14 located in a passage-way of the housing 6 of the switch 44 enclosing a release mechanism. The pin 14 is pre-stressed by a spring towards its inoperative position. The release pin 14 is sealed relative to the housing 6 by an O-ring. However, it may also be sealed by a membrane stretched across the free end of the release pin 14 or designed as part of the housing so that it comes to rest against the release pin 15.

The detector 3 includes a spherical head which rests on the bearing 2 fixed to the ski. The detector 3 comprises force pickups 4 sensing the torques ± My and ± Mz exerted exerted about the axis of rotation of the binding plate 1 and converting them into electrical signals. The force pickups 4 may comprise, for instance, piezoelectric transducer or strain gauges, and they are connected to the housing of the switch 44. The switch housing houses a battery, an analyzing circuit, an electromechanical release component such as an electromagnet, and parts of a mechanical locking system of the binding. The release mechanism also may include other components such as a piezoelectric transducer. The switch 44 itself is not an object of the present invention and may be designed, for instance, as in the application, Ser. No. A 2199/86.

The release mechanism of the switch 44 is rigidly connected by a sealed shaft 7 passing through the switch housing to an outer snap-in arm 22. In order to reduce friction, snap-in arm 22 is preferably designed as a roller lever. The outer snap-in arm 22 supports, in the operational state of the bind, the outer support lever which pivots about the spindle 29 rigidly connected to the binding plate 1. The outer support lever 21 acts as a bearing for the compression spring 19 which, as already explained, presses the arm 18 supporting the detent track 31 against the detent-roller 16 of the heel-piece 5.

Figure 2A:
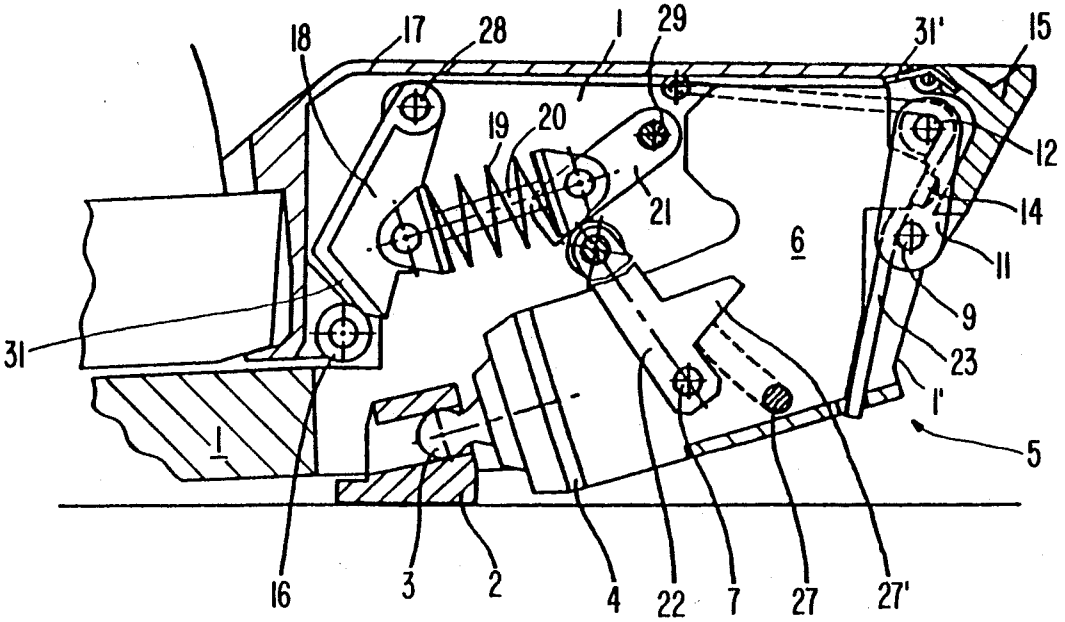
Figure 2B:
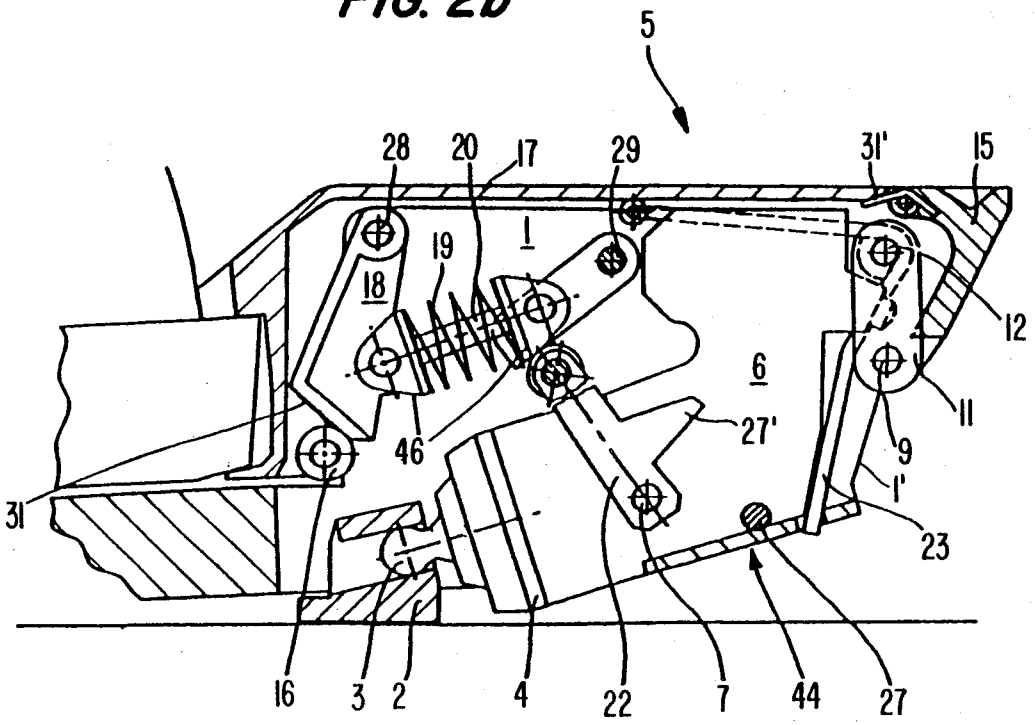
Figure 2C:
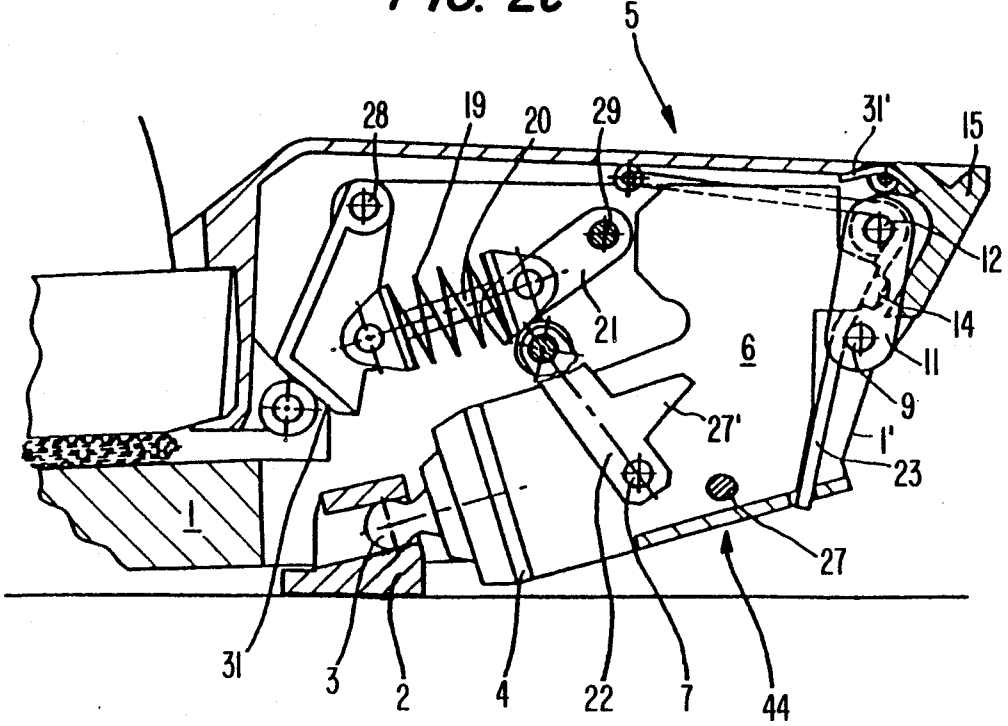

As shown by FIGS. 2*a*–2*c*, the outer support 21 rests in such a manner on the outer snap-in arm 22 that the outer support lever, with respect to the outer snap-in arm 22, subtends an angle slightly exceeding 90° in order to exert a torque on the outer snap-in arm 22. The outer snap-in arm 22 thereby is prestressed toward the unlocked position. This torque is absorbed by the release mechanism, which thereby is pre-stressed towards its unlocked position. The torque acting on the snap-in arm 22 enhances any release, which is only negigibly hampered by ice accumulation. Hence, release is possible when slight forces are exerted by the release mechanism.

Upon deliberate or accidental release in the swinging up of the sole-holder 17, an attachment 27 of the sole-holder 17 comes to rest against a stud 27' of the snap-in arm 22, which thereby is rotated back into its operational position. When the outer snap-in arm 22 is rotated back, the shaft 7 also effects a resetting of the release mechanism. This rotational reset requires only slight force because the compression spring 19 acts only on the arm 18 and the outer support lever 21 which are connected by the coupling rod 20. During the depression of the sole-holder 17, the detent-roller 16 moves over the arm 18 within the detent-track 31, and the compression spring 19 is thereby compressed. The sole-holder is then relocked as a result.

As shown by FIGS. 2–5, the sole-holder 17 is held on the binding plate 1 by a link mechanism. The link mechanism consists of a pair of link arms 11 resting on two pivot pins 9, 12, which in the operational position of the heel-piece 5 are transverse to the ski and parallel to its surface. Specifically, the hood shaped sole-holder 17 hinges on spindle 9, and the spindle 12 is held in a rib 1' projecting from the binding plate 1. The sole-holder 17 is connected only by the link arms 11 to the binding plate. The detent-locking of the sole-holder 17 to the binding plate 1 is effected by the dent-roller 16 engaging the detent-track 31, which is pivotally supported on the binding plate. The detent-roller 16 engages the detent-track 31 in the operational position of the sole-holder 17.

FIG 2*a* represents the optimal adjustment condition of the binding. As shown in FIG. 2*a*, the compression spring 19 presses the arm toward the boot. The arm 18 hinges on the spindle 28 connected to the binding plate 1, i.e., to its rib, and presses against the detent-roller 16, whereby a force component in a longitudinal direction of the ski is also produced. This force component causes the sole-holder 17 to advance toward the boot, whereby the link arms 11 assume a position slanting with respect to the vertical on account of the hinging of the sole-holder 17 on the lower spindle 9.

As shown in FIG. 2*b*, if a minute deviation from the ideal adjustment from the heel-piece 5 takes place, which is inevitable in boot soles made of hygroscopic material, this deviation can be absorbed by the link arms 11 on which the sole-holder 17 hinges. In the process, one of the link arms 11 assumes a vertical or slightly rearward slanting position. As a result the compression spring 19 is compressed somewhat more. However, the application point of the compression spring on the arm also changes because the arm 18 is now more vertical. Therefore, the point of application of the spring 19 migrates down, yet the support point of the spring 19 remains the same. If the arm 18 and the outer support lever 21 and the snap-in arm 22 and their hinging points are properly dimensioned, it is possible to achieve a release substantially uneffected by such changes in length.

FIG. 2*c* shows the heel-piece of FIGS. 2*a* or 2*b* at a defective setting due to a layer of snow on the sole. Because of the raised position of the sole-heel area of the heel-piece 5 in this condition, the compression spring 19 is compressed. However, as a result of the sloping of the detent-track 31, the leverage changes, and the part of the arm 18 resting on the detent-roller 16 is shortened. By suitably selecting the design dimensions, the release conditions are affected only insignificantly.

Figure 4A:
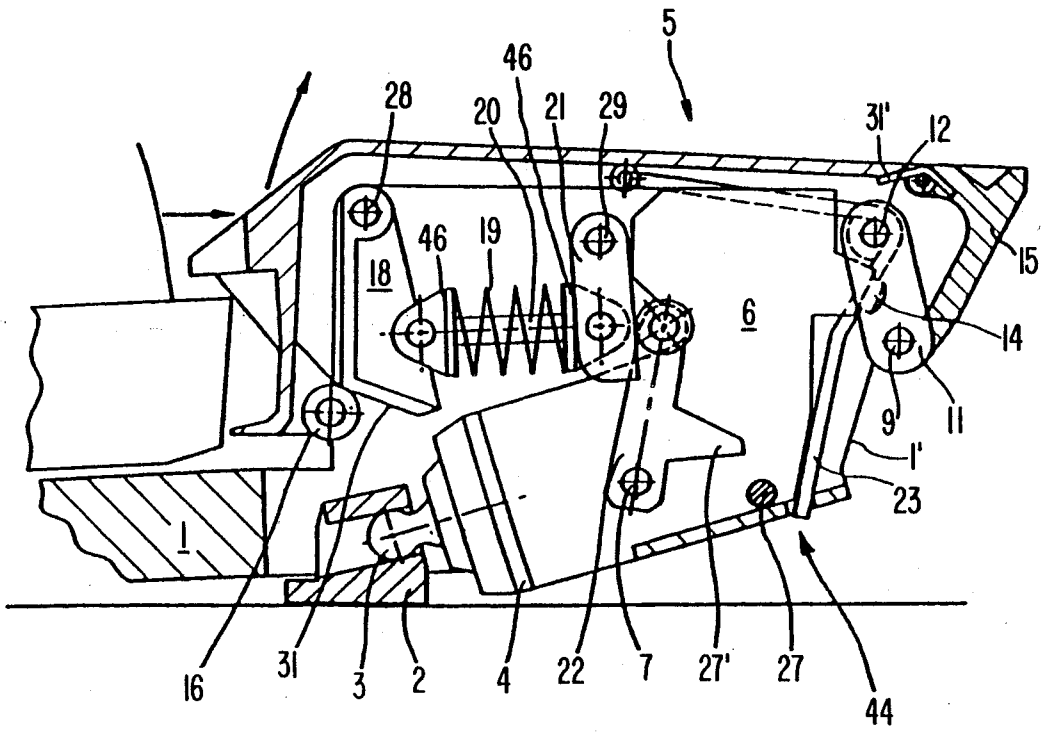
Figure 4B:
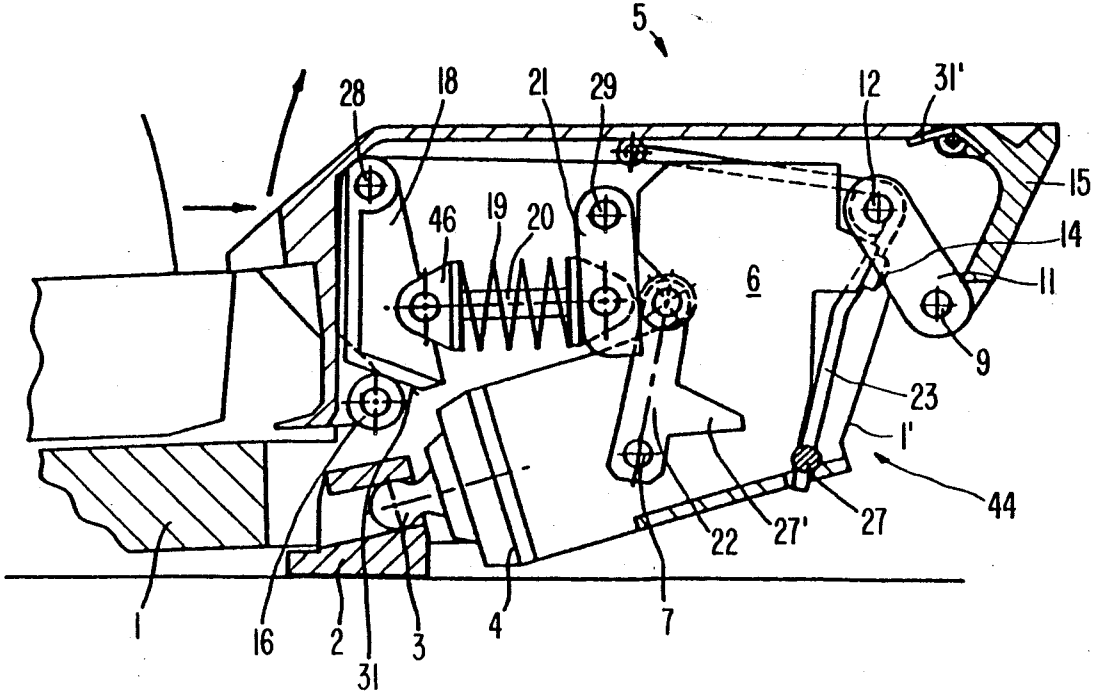

FIG. 3 shows the heel-piece 5 of the present invention following the release of the switch 44. The snap-in arm 22 already has left its position of rest on the support lever 21 and has reached its released position. This is made possible by the unlocking of the shaft inside the switch 44 supporting the support lever 21 and by the torque exerted by the support lever 21 on the snap-in arm 22 in the direction of its release. As a result the compression spring 19 loses its bearing formed by the support lever 21 and the snap-in arm 22, and hence, together with the arm 18 and the support lever 22, exerts no outward force. As shown in FIGS. 4*a* and 4*b*, the sole-holder can be moved to the rear, even for small forces exerted by the boot on it. The link arms 11 then deflect. Further, the sole-holder 17 can be pivoted upwardly with no significant force, this action being enhanced by the opening spring 31'.

FIG. 5 shows the heel-piece of the invention with a sole-holder 17 that has swung upwardly following release. In this position, as already discussed, the pivoting motion of the sole-holder 17 resets the snap-in arm 22 and thereby the release mechanism in the switch 44. This takes place by the attachment 27 on the sole-holder 17 coming to rest against the attachment 27' of the snap-in arm 22.

Additional advantages and modifications will readily occur to those skilled in the art. The invention in its broader aspects is, therefore, not limited to the specific details, representative apparatus and illustrative examples shown and described. Accordingly, departures may be made from such details without departing from the spirit or scope of the general inventive concept as defined by the dependent claims and their equivalence.

We claim:

1. A heel-piece for a safety ski binding comprising:

a binding plate adapted to be pivotally attached to a ski;

a sole holder pivotally movable on said binding plate from a closed position, wherein said sole holder is in operation, to an open position, wherein said sole holder is released from the binding plate in a vertical direction;

link means for connecting said sole holder to said binding plate, said link means including at least one link arm and first and second pivot pins passing through said link arm to allow rotation of the link arm about the first and second pivot pins, wherein said first pivot pin comprises the axis of rotation of the sole holder about the binding plate, said second pivot pin is held on the binding plate by a rib projecting therefrom, and said first and second pivot pins are substantially parallel to each other and substantially perpendicular to the longitudinal axis of the ski; and detent means for holding said sole holder in said closed position, said detent means including a detent mounted on one of said binding plate and said sole holder and a detent track mounted on the other of said binding plate and said sole holder, said detent being positioned in said detent track.

2. The heel piece as claimed in claim 1, wherein said link means is mounted on a first end of the sole holder.

3. The heel piece as claimed in claim 1, wherein said detent track is mounted on a pivot arm, said pivot arm being pivotally mounted on said binding plate.

4. The heel-piece as claimed in claim 3, further comprising a compression spring contacting said pivot arm at one end of said spring and an abutment at the other end thereof.

5. The heel-piece as claimed in claim 4, wherein said abutment includes a support arm pivotally mounted on said binding plate and a snap-in arm abutting said support arm when said sole holder is in operation, said support arm resting on an outer peripheral surface of the snap-in arm.

6. The heel piece as claimed in claim 1, wherein said binding plate is pivotally mounted about a pivot boss located at the intersection of the axis of the tibia of a skier and the plane of the ski and about a third pivot pin located transverse to the longitudinal axis of the ski and parallel to the ski surface.

7. The heel-piece as claimed in claim 5, further including control means for controlling the movement of the abutment.

8. The heel-piece as claimed in claim 7, wherein the control means includes release means for controlling the movement of the support arm.

9. The heel-piece as claimed in claim 7, wherein the control means includes setting means for controlling the movement of the snap-in arm.

10. A heel-piece for a safety ski binding comprising:

a binding plate adapted to be fixedly attached to a ski and being pivotally mounted about a pivot boss located at the intersection of the axis of the tibia of a skier and the plane of the ski and about a third pin located transverse to the longitudinal axis of the ski and parallel to the ski surface;

a sole holder pivotally connected to said binding plate, said sole holder being pivotally movable on said binding plate from a closed position, in which said sole holder is in operation, to an open position, in which said sole holder is pivotally released from the ski;

link means for connecting said sole holder to said binding plate, said link means including a link arm and first and second pivot pins passing through said link arm, said first and said second pivot pins being substantially parallel to each other and substantially perpendicular to the longitudinal axis of the ski;

detent means for holding said sole holder in said closed position, said detent means including a detent mounted on one of said binding plate and said sole holder and a detent track mounted on the other of said binding plate and said sole holder, said detent being positioned in said detent track; and detecting means for detecting the torque exerted about the axis of rotation of the binding plate, the detecting means including a detector spaced from said pivot boss along the longitudinal axis of the ski and having a spherical end received in a support fixed to the ski.

11. The heel-piece as claimed in claim 10, wherein the detecting means further includes a transducer connecting the detector to said binding plate.

12. The heel-piece as claimed in claim 11, further including switch means mounted on the binding plate, the switch means being disposed in a switch housing.

13. The heel-piece as claimed in claim 12, wherein the detecting means further includes an electronic circuit for analyzing the output of the transducer, the electronic circuit being disposed in the switch housing.

14. A heel-piece for a safety ski binding comprising:

a binding plate adapted to be fixedly attached to a ski;

a sole holder pivotally connected to said binding plate, said sole holder being pivotally movable on said binding plate from a closed position, in which said sole holder is in operation, to an open position, in which said sole holder is pivotally released from the ski;

link means for connecting siad sole holder to said binding plate, said link means including a link arm and first and second pivot pins passing through said link arm, said first and second pivot pins being substantially parallel to each other and substantially perpendicular to the longitudinal axis of the ski; and detent means for holding said sole holder in said closed position, said detent means including a detent mounted on one of said binding plate and said sole holder and a detent track mounted on the other of said binding plate and said sole holder, said detent being positioned in said detent track and comprising a roller rotatably supported on said sole holder.--

15. A heel-piece for a safety ski binding comprising:

a binding plate adapted to be fixedly attached to a ski;

a sole holder pivotally connected to said binding plate, said sole holder being pivotally movable on said binding plate from a closed position, in which said sole holder is in operation, to an open position, in which said sole holder is pivotally released from the ski;

link means for connecting said sole holder to said binding plate, said link means including a link arm and first and second pivot pins passing through said link arm, said first and second pivot pins being substantially parallel to each other and substantially perpendicular to the longitudinal axis of the ski;

detent means for holding said sole holder in said closed position, said detent means including a detent mounted on one of said binding plate and said sole holder and a detent track mounted on the other of said binding plate and said sole holder, said detent being positioned in said detent track, said detent track being mounted on a pivot arm, said pivot arm being pivotally mounted on said binding plate;

a compression spring abutting said pivot arm at one end of said spring and an abutment at the other end thereof, said abutment including a support arm pivotally mounted on said binding plate and a snap-in arm supporting said support arm when said heel-piece is in operation, said support arm resting on an outer peripheral surface of the snap-in arm and loading the snap-in arm along the longitudinal direction thereof, said support arm being connected to said pivot arm by a telescopic coupling rod, said telescopic coupling rod guiding said compression spring.

16. A heel-piece for a safety ski binding comprising:

a binding plate adapted to be pivotally attached to a ski;

a sole holder pivotally movable on said binding plate from a closed position, wherein said sole holder is in operation, to an open position, wherein said sole holder is released from the binding plate in a vertical direction;

link means for connecting said sole holder to said binding plate, said link means including at least one link arm and first and second pivot pins passing through said link arm to allow rotation of the link arm about the first and second pivot pins, said second pivot pin being held on the binding plate by a rib projecting therefrom and said first and second pivot pins being substantially parallel to each other and substantially perpendicular to the longitudinal axis of the ski; and detent means for holding said sole holder in said closed position, said detent means comprising a roller rotatably supported on said sole holder and a detent tract mounted on said binding plate, said roller being positioned in said detent track.

17. A heel-piece for a safety ski binding comprising:

a binding plate adapted to be pivotally attached to a ski;

a pivot arm pivotally mounted on said binding plate;

a sole holder pivotally movable on said binding plate from a closed position, wherein said sole holder is in operation, to an open position, wherein said sole holder is released from the binding plate in a vertical direction;

link means for connecting said sole holder to said binding plate, said link means including at least one link arm and first and second pivot pins passing through said link arm to allow rotation of the link arm about the first and second pivot pins, said second pivot pin being held on the binding plate by a rib projecting therefrom and said first and second pivot pins being substantially parallel to each other and substantially perpendicular to the longitudinal axis of the ski;

detent means for holding said sole holder in said closed position, said detent means including a detent mounted on said sole holder and a detent track mounted on said pivot arm, said detent being positioned in said detent track;

a compression spring having a first end and a second end, the compression spring contacting said pivot arm at the first end;

an abutment disposed at the second end of the compression spring, the abutment including a support arm pivotally mounted on said binding plate and a snap-in arm abutting said support arm when said sole holder is in operation, said support arm resting on an outer peripheral surface of the snap-in arm; and a telescopic coupling rod for connecting said support arm and said pivot arm, said telescopic coupling rod guiding said compression spring.

18. A heel-piece for a safety ski binding comprising:

a binding plate adapted to be pivotally mounted on a ski about a pivot boss located at the intersection of the axis of the tibia of a skier and the longitudinal plane of the ski and about a binding plate pivot pin located transverse to the longitudinal axis of the ski and parallel to the ski surface;

detecting means for detecting the torque exerted about the axis of rotation of the binding plate, the detecting means including a detector spaced from said pivot boss along the longitudinal axis of the ski and having a spherical end received in a support fixed to the ski;

a sole holder pivotally movable on said binding plate from a closed position, wherein said sole holder is in operation, to an open position, wherein said sole holder is released from the binding plate in a vertical direction;

link means for connecting said sole holder to said binding plate, said link means including at least one link arm and first and second pivot pins passing through said link arm to allow rotation of the link arm about the first and second pivot pins, said second pivot pin being held on the binding plate by a rib projecting therefrom and said first and second pivot pins being substantially parallel to each other and substantially perpendicular to the longitudinal axis of the ski; and detent means for holding said sole holder in said closed position, said detent means including a detent mounted on one of said binding plate and said sole holder and a detent track mounted on the other of said binding plate and said sole holder, said detent being positioned in said detent track.

19. A heel-piece for a safety ski binding comprising:

a binding plate adapted to be pivotally attached to a ski;

a pivot arm pivotally mounted on said binding plate;

a sole holder pivotally movable on said binding plate from a closed position, wherein said sole holder is in operation, to an open position, wherein said sole holder is released from the binding plate in a vertical direction;

link means for connecting said sole holder to said binding plate, said link means including at least one link arm and first and second pivot pins passing through said link arm to allow rotation of the link arm about the first and second pivot pins, said second pivot pin being held on the binding plate by a rib projecting therefrom and said first and second pivot pins being substantially parallel to each other and substantially perpendicular to the longitudinal axis of the ski;

detent means for holding said sole holder in said closed position, said detent means including a detent mounted on said sole holder and a detent track mounted on said pivot arm, said detent being positioned in said detent track;

a compression spring having a first end and a second end, the compression spring contacting said pivot arm at said first end;

an abutment disposed at the second end of the compression spring, said abutment including support arm pivotally mounted on said binding plate and a snap-in arm abutting said support arm when said sole holder is in operation, said support arm resting on an outer peripheral surface of the snap-in arm; and control means for controlling the movement of the abutment, the control means including release means for controlling the movement of the support arm and switch means for actuating the release means, the switch means being disposed in a switch housing.

20. The heel piece as claimed in claim 18, wherein the detecting means includes a transducer connecting said detector to said binding plate.

21. The heel-piece as claimed in claim 19, wherein the control means further includes an electronic circuit mounted in the switch housing.

22. The heel-piece as claimed in claim 20, further including release means for controlling the movement of the detent track and switch means for actuating said release means, said switch means being disposed in a switch housing.

23. The heel-piece as claimed in claim 22, wherein the detecting means further includes an electronic circuit for analyzing the output of the transducer, the electronic circuit being disposed in the switch housing.

* * * * *